US006937155B2

(12) United States Patent
Ballard

(10) Patent No.: US 6,937,155 B2
(45) Date of Patent: Aug. 30, 2005

(54) TOILET ANNUNCIATOR

(76) Inventor: Jodie L. Ballard, 4350 Mahogany Cir., Yorba Linda, CA (US) 92886

( * ) Notice: Subject to any disclaimer, the term of this patent is extended or adjusted under 35 U.S.C. 154(b) by 112 days.

(21) Appl. No.: 10/364,114

(22) Filed: Feb. 10, 2003

(65) Prior Publication Data

US 2004/0155779 A1 Aug. 12, 2004

(51) Int. Cl.[7] ..... G08B 23/00
(52) U.S. Cl. ..... 340/573.1; 340/623
(58) Field of Search ..... 340/573.1, 693, 340/692, 691.1, 604, 605, 602, 566, 618, 623; 200/DIG. 41, DIG. 40, 182, 190, 185, 61.04, 61.05, 61.06, 61.07

(56) References Cited

U.S. PATENT DOCUMENTS

| | | | | |
|---|---|---|---|---|
| 2,721,531 A | | 10/1955 | Findley, Jr. | |
| 3,059,608 A | | 10/1962 | Lee | |
| 3,172,390 A | | 3/1965 | Garthotner | |
| 3,715,549 A | | 2/1973 | Kraff | |
| 4,547,768 A | * | 10/1985 | Kulhavy | 340/620 |
| 4,804,947 A | * | 2/1989 | Geleziunas | 340/620 |
| 4,849,742 A | * | 7/1989 | Warrington | 340/545.6 |
| 4,896,144 A | | 1/1990 | Bogstad | |
| 5,560,051 A | | 10/1996 | Butts | |
| 5,573,407 A | | 11/1996 | Dunford | |
| 5,870,015 A | | 2/1999 | Hinkel | |
| 6,028,520 A | * | 2/2000 | Maehre | 340/573.1 |
| 6,058,519 A | * | 5/2000 | Quintana | 4/427 |
| 6,178,569 B1 | * | 1/2001 | Quintana | 4/427 |
| 6,417,773 B1 | * | 7/2002 | Vlahos et al. | 340/573.1 |

FOREIGN PATENT DOCUMENTS

| | | |
|---|---|---|
| AU | 408193 | 9/1969 |
| JP | 10317456 | 12/1990 |
| JP | 11140938 | 5/1999 |
| JP | 200314168 | 11/2000 |

* cited by examiner

*Primary Examiner*—John Tweel, Jr.
(74) *Attorney, Agent, or Firm*—Gene Scott, Patent Law & Venture Group

(57) ABSTRACT

An annunciating apparatus comprises a toilet tank containing water and an electrical circuit within an enclosure. Extending upwardly from the enclosure, an arm terminates with a hook engaging the toilet tank for suspending the enclosure in a position just below the toilet tank. The electrical circuit provides a source of electricity, an activating circuit, a sound producing circuit, a sound selecting circuit, an amplifying circuit and a speaker. This circuit is enabled for producing a selected sound from the speaker when the toilet tank is flushed. Two modes are possible; one where the sound is initiated by the water in the tank dropping during flush, and the second when a selected flush related sound is picked up.

2 Claims, 4 Drawing Sheets

TOILET ANNUNCIATOR

INCORPORATION BY REFERENCE: Applicant(s) hereby incorporate herein by reference, any and all U.S. patents, U.S. patent applications, and other documents and printed matter cited or referred to in this application.

BACKGROUND OF THE INVENTION

1. Field of the Invention

This invention relates generally to mechanized announcement or sound producing devices and more particularly to such a device as used with a toilet.

2. Description of Related Art

The following art defines the present state of this field:

Findley, Jr., U.S. Pat. No. 2,721,531 describes a toilet signal device for training infants comprising a toilet seat, a signal device, and actuator for said signal device terminating in a substantially hooked portion, hooked means extending from the other end of said toilet seat and carried by the latter, and a disposable trip supported at each end by said hooked portion of said actuator and said hook means.

Lee, U.S. Pat. No. 3,059,608 describes a training chair comprising a child's chair construction having a seat provided with an accommodation opening, a normally horizontal load-responsive downwardly tilting receptacle, means fixed to the chair structure in a plane below the seat pivotally suspending said receptacle below and in alignment with said opening with the upper portion normally spaced below the underneath side of said seat, a tripping lever constituting a load-responsive normally balanced beam and being provided with adjustable balancing means, means supporting said lever for pivotal movement, said lever and means being offset relative to a rearward tilting portion of said receptacle, a load responsive terminal at one end of said lever upon which a minimal marginal portion of the bottom of said receptacle is supported, free-turning rotating force multiplication motion transmitting means, and flexible means associated and operatively connected with said last named means providing forces for the actuation of a sound emitting signaling device mounted cooperatively on said chair.

Garthofner, U.S. Pat. No. 3,172,390 describes a toilet training chair comprising supporting sides and a seat connected therebetween, said seat having an opening, a planar surfaced support member, means pivotally mounting the support member to said sides beneath the seat, tensioned spring means disposed forwardly of the pivotal mounting means connected to the seat and the support member for urging the support member to a substantially horizontal position with respect to the seat, a receptacle positioned on said support member below said opening, a musical device having a gravity operated actuating member mounted on one of said sides, and an upright control member carried by said support member cooperating with said actuating member for normally holding the actuating member in a raised inoperative position and permitting the musical device to be operated when the support member is caused to pivot downwardly by the introduction of a waste product into said receptacle whereby the control member is moved away from said actuating member to thereby permit said actuating member to be lowered under its own weight to actuate the musical device.

Kraff, U.S. Pat. No. 3,715,549 describes a conventional water closet having a water box, bowel, and flushing means, there is provided a music box or sound emitting device which will produce a pleasant sound in response to manual flushing of the water closet.

Warrington, U.S. Pat. No. 4,849,742 describes a signaling device that is actuated for a limited period of time if a toilet seat cover is not promptly lowered following flushing of the toilet. In the preferred form, an electrically operated signaling device is coupled to an electrical power source through a magnetically actuated switch at the front of the toilet tank and also through a second switch. A magnet fastened to the seat cover closes the magnetically actuated switch when the cover is in the raised position and movement of a float in the toilet tank in response to flushing closes the second switch for a limited period following initiation of flushing. The device reminds users of the toilet to close the cover. This avoids discomfort to a subsequent user of the toilet and assures that small children and pets are blocked from the toilet bowl.

Bogstad, U.S. Pat. No. 4,896,144 describes a warning system that is adapted to warn someone to wash their hands prior to leaving or entering a facility in which hand washing is important. The system includes a door activated system that can be either visible or audible or both and can include a door locking system and a remote signaling system. The warning system is armed when the door is opened to permit entry into the facility and is de-activated upon the actuation of hand-washing facilities. In one embodiment, the system is used in a bathroom and the warning system can be activated by the flushing of a toilet.

Butts, U.S. Pat. No. 5,560,051 describes a sound-generating toilet training device for use with a conventional potty chair comprising a self supporting base member having a generally planar top face and a bottom face, the base member is adapted to be removably received within a receptacle of the potty chair, an actuating member is positioned on the top face for actuating an electronic circuit, the actuating member including a pair of interleaved contact members insulated from each other, a generating member coupled to the actuating member is also provided for generating an output signal, the generating member being sealed against fluid contact and an emitting member, the emitting member is responsive to the output signal and emits an audible sound, the generating member and the emitting member are positioned on the base member whereby when the device is positioned within a potty chair receptacle and a child urinates thereon, the contact members are caused to be bridged by the urine enabling an output signal to be generated that is emitted as an audible sound for the enjoyment of the child.

Dunford, U.S. Pat. No. 5,573,407 describes an apparatus and method for training a child to complete a toilet training experience. The invention includes an object placed in close proximity to a toilet appropriate for training the child. The invention also includes a device for emitting a musical sound. Upon successful completion of a toilet training experience, the child is provided a reward token, such as a coin. The child may then place the token into the object, which may comprise a piggy bank. In response to placement of the token into the object, the music emitting device generates a musical sound. The method allows the child to associate the object visually with the training experience and to associate the musical sounds audibly with the training experience.

Hinkel, U.S. Pat. No. 6,870,015 describes a toilet instruction method and apparatus in which toilet use is monitored and one or more audible messages is produced which instruct users of the toilet regarding next steps in toilet use and hygiene. The apparatus includes a housing which is removably attachable to the toilet. A switch arm extends from the housing and is coupled with the toilet flush handle.

An audio speaker is partly enclosed within the housing and produces the audible messages. Electronic circuitry enclosed within the housing receives a switch activity signal indicative of the position of the switch arm and responsively activates production of the audible messages. The electronic circuitry includes a message storage unit for storing a plurality of messages.

Machre, U.S. Pat. No. 6,028,520 describes an enunciator for training individuals in toilet etiquette and sanitation. The enunciator has a small housing that hangs on the side of the toilet tank, is incorporated into the seat of the toilet or hangs from the flush handle of the toilet. The housing is preferably plastic and can be animal shaped, for example, like a frog. A sound module, batteries, internal sensors, controller and speaker are mounted in the housing and the controller is connected to the external sensors by electrical wires. A small light such as an LED can be included to indicate that the unit is working. The sensors detect a person near the toilet, the position of the toilet seat (lowered or raised), a person sitting on the seat, and operation of the flush handle. The controller decides what messages to play based on the sensed conditions. Additionally, the housing may contain a small separate tape player for music or prerecorded humorous sounds. The tape player is controlled by the enunciator to coordinate with any played messages. An on/off switch and volume control are also provided.

Vlahos et al., U.S. Pat. No. 6,417,773 describes a system for encouraging good personal hygiene in toilet facilities, including means for detecting the acoustic signal generated by the inrush of water into a toilet bowl to trigger a recorded admonition to the toilet user to cleanse his or her hands.

Glew, AU 408193, describes a toilet training device comprising a dry pan receptacle, moisture responsive electrode means located in the base of the receptacle, electric control means detachably connected to said electrode means, and musical production means operably controlled by said electric control means such that when the electrodes are bridged by liquid or moisture in the receptacle a circuit of said electric control means is completed by thereby actuate said musical production means.

Katsuyoshi, JP 10317456 describes an imitation sound generator, in which flush water is not consumed more than required and an imitation sound can also be used comfortably as the sound of natural feeling. The device is annexed to a flush water tank 3 for flushing a stool connected to a water supply piping, and has a detecting means detecting a user at a time when a flushing imitation sound is generated in response to the time of easing nature and a water supply means supplying the flush water tank 3 with water by a signal input from the detecting means. A standby period, when a supply water level to the flush water tank 3 from the water supply piping is kept low and the generation of an imitation sound is prepared, and an imitation-sound operating period, when supply water by the water supply means is discharged from a section upper than the supply water level during the standby period on the basis of the signal input from the detecting means after the standby period, are repeated.

Katsuyoshi, JP 11140938 describes a sound-effects generator by which a sound-effect due to an actual flow of flushing water can be obtained in a simple device regardless of the existence of a washing water tank such as a low tank. This sound-effects generator is provided with a recovery pipe 7 of which the upper end of the passage is positioned in the inside of a sound-effects chamber 5b which can hold water and of which the upper level is set to be the maximum water storage level in the second-effects chamber 5b, a water supply pipe 6 of which the upper end of the passage is positioned above the upper end of the flow passage of the recovery pipe 7 and of which the delivery direction faces the water storage face side, and a solenoid valve 8 incorporated halfway in the water supply side pipe 6. The water supply pipe 6 is connected to the upstream of the valve opening/closing the passage, provided in the passage way for supplying washing water to a flushing toilet seat and the recovery pipe 7 is connected to the downstream thereof.

Toto, LTD., JP 2000314168 describes enhancing imitation sound effect and improving the operation and execution by incorporating an imitation sound device in a toilet stool. A space part 5 in the rear part of a flushing valve flushing type flush toilet 3 is molded integrally with a flushing water toilet stool 3, and an imitation sound device 1 is incorporated in the space part. For instance, an opening part 6 communicating with the space part 5 is provided on the side of the flushing water toilet stool body 3, and the sound generation part such as a speaker of the imitation device 1 is provided by facing the opening part 6. In addition, the operation part 2 of the sound imitation device 1 is attached to the wall face 9 of a toilet. In the case where the imitation sound device is not projected to the outside of the flushing water toilet stool 3 and the operation part or the like of a warm water flushing device is installed adjacently by providing it in the space part 5 of the flushing water toilet stool 3, they are not treated as a nuisance. A sound generated from the imitation sound device 1 can be heard to have no sense of incompatibility with a flushing sound flowing from the flushing water toilet stool 3. In addition, since the imitation sound generation part is incorporated in the inside of the toilet stool, the arrangement of the remote control operation part or the like of other devices is facilitated.

The prior art teaches toilet signaling devices having music and other sounds for training children, mechanically tripped when flushing action occurs or related to seat or lid position, related to hand washing, with receipt of a token, sensed motion, water rushing sound, by water level, but the prior art does not teach such a device with choice of sound and activation through toilet actuation noise or water flush, and which is easily hung on a toilet tank. The present invention fulfills these needs and provides further related advantages as described in the following summary.

SUMMARY OF THE INVENTION

The present invention teaches certain benefits in construction and use which give rise to the objectives described below.

An annunciating apparatus comprises a toilet tank containing water and an electrical circuit within an enclosure. Extending upwardly from the enclosure, an arm terminates with a hook engaging the toilet tank for suspending the enclosure in a position just below the toilet tank. The electrical circuit provides a source of electricity, an activating circuit, a sound producing circuit, a sound selecting circuit, an amplifying circuit and a speaker. This circuit is enabled for producing a selected sound from the speaker when the toilet tank is flushed. Two modes are possible; one where the sound is initiated by the water in the tank dropping during flush, and the second when a selected flush related sound is picked up.

A primary objective of the present invention is to provide an apparatus and method of use of such apparatus that provides advantages not taught by the prior art.

Another objective is to provide such an invention capable of being easily mounted on a toilet tank.

A further objective is to provide such an invention capable of being activated by water dropping within the toilet tank.

A still further objective is to provide such an invention capable of being activated by the sound of flushing action within the toilet tank.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 4:
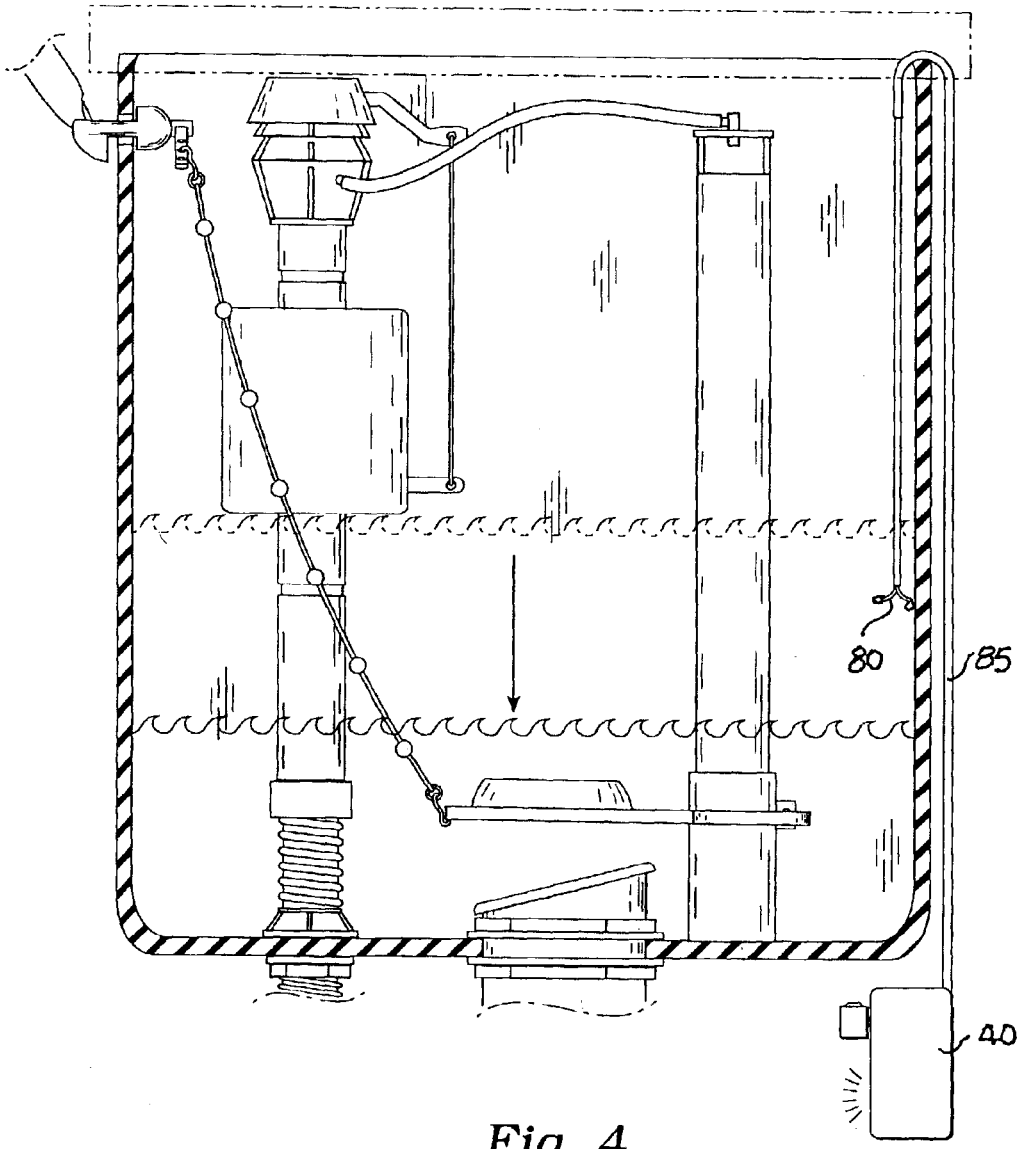
Figure 5:
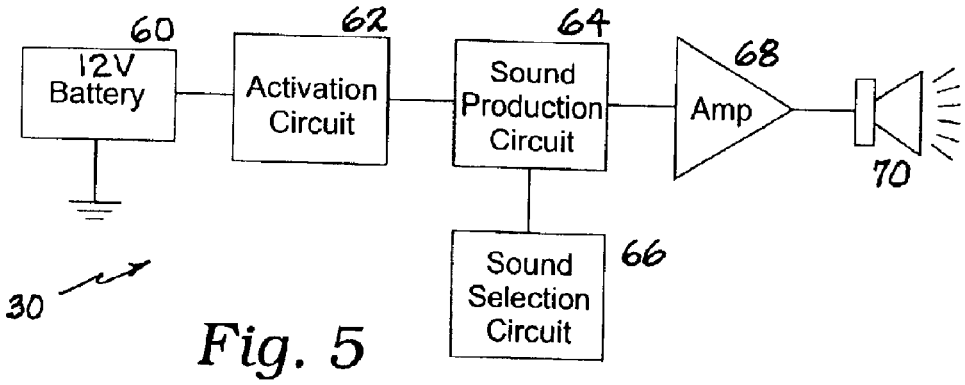
FIG. 5 is a block diagram thereof.

The present invention is an annunciating apparatus for use in toilets. It comprises the combination of a toilet tank 10 containing water 20 and an electrical circuit 30 within an enclosure 40. Extending upwardly from the enclosure 40 is an arm 50 terminating with a hook 52 which engages the toilet tank 10. The enclosure 40 is therefore suspended from the arm 50 in a position just below the toilet tank 10, as shown in FIGS. 4 and 4 and is therefore generally not in plain sight to a person within the toilet. The electrical circuit 30 provides a source of electricity such as battery 60, an activating circuit 62, a sound producing circuit 64, a sound selecting circuit 66, an amplifying circuit 68 and a speaker 70, the activating, producing, selecting and amplifying circuits engaged with the speaker 70 for enabling selected sound output through the speaker when the toilet tank 10 is flushed.

Figure 7:
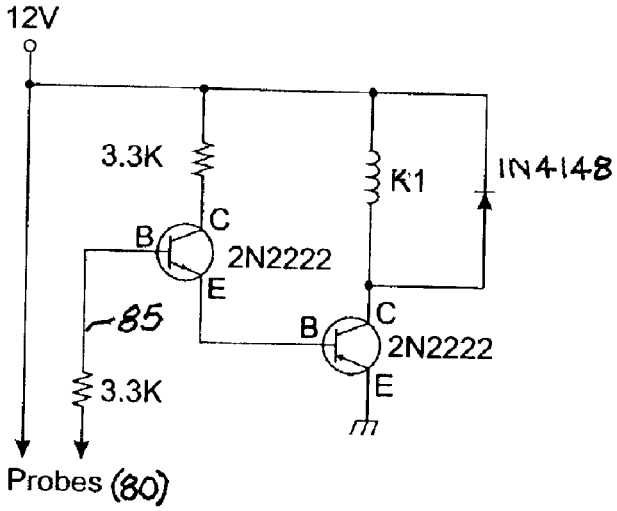
FIG. 7 is a schematic diagram thereof showing a water level activated embodiment.

The activating circuit 62, in a first embodiment, shown in FIG. 7, comprises an open-circuit probe 80, the probe placed so as to be immersed in the water 20 of the toilet tank 10 when the tank is filled, and not immersed in the water 20 when the tank is flushed. When not immersed, the electrical resistance raises triggering the 2N2222 transistor in FIG. 7 causing current flow in relay coil K1 which enables a set of contacts (not shown) in the sound producing circuit 64.

Figure 6:
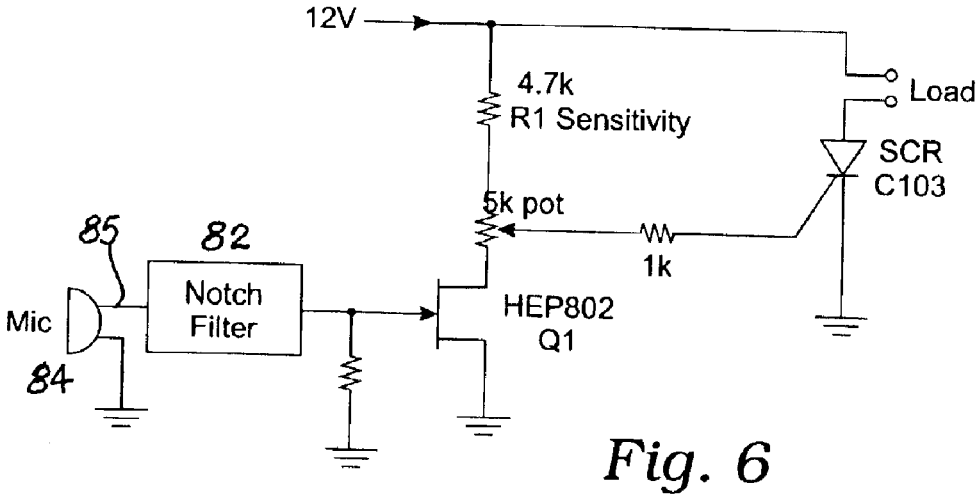
FIG. 6 is a schematic diagram thereof showing a sound activated embodiment.

In an alternate embodiment shown in FIG. 6, the activating circuit 62 uses a notch filter 82 accepting only a selected range of audio frequencies as produced by the microphone 84 as produced by toilet flush sounds, and activates Q1 in FIG. 6. In this case, the filter 82 may be tuned to any narrow band pass that will discriminate between the toilet flush sounds and other sounds in the toilet such as tap water sounds, voice sounds and the other many sounds normal to a toilet environment.

Figure 1:
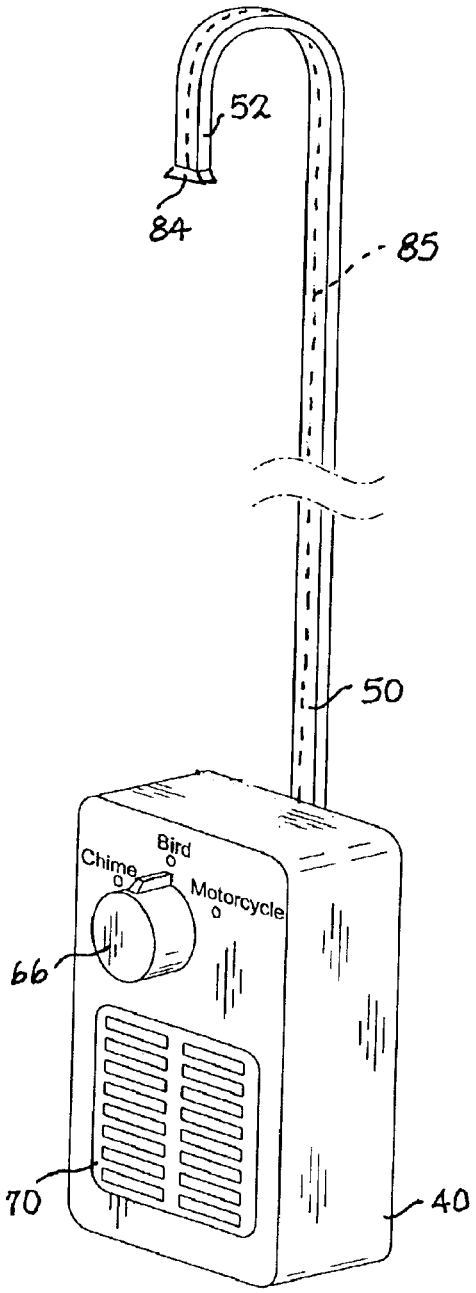
FIGS. 1 and 2 are perspective views of preferred embodiments of the invention.
Figure 2:
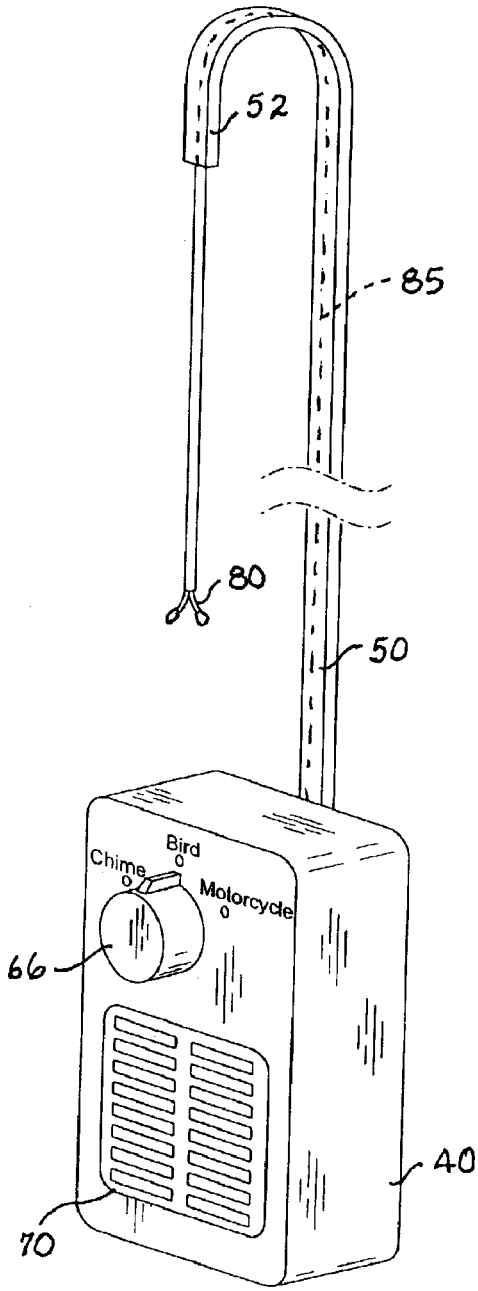
Figure 3:
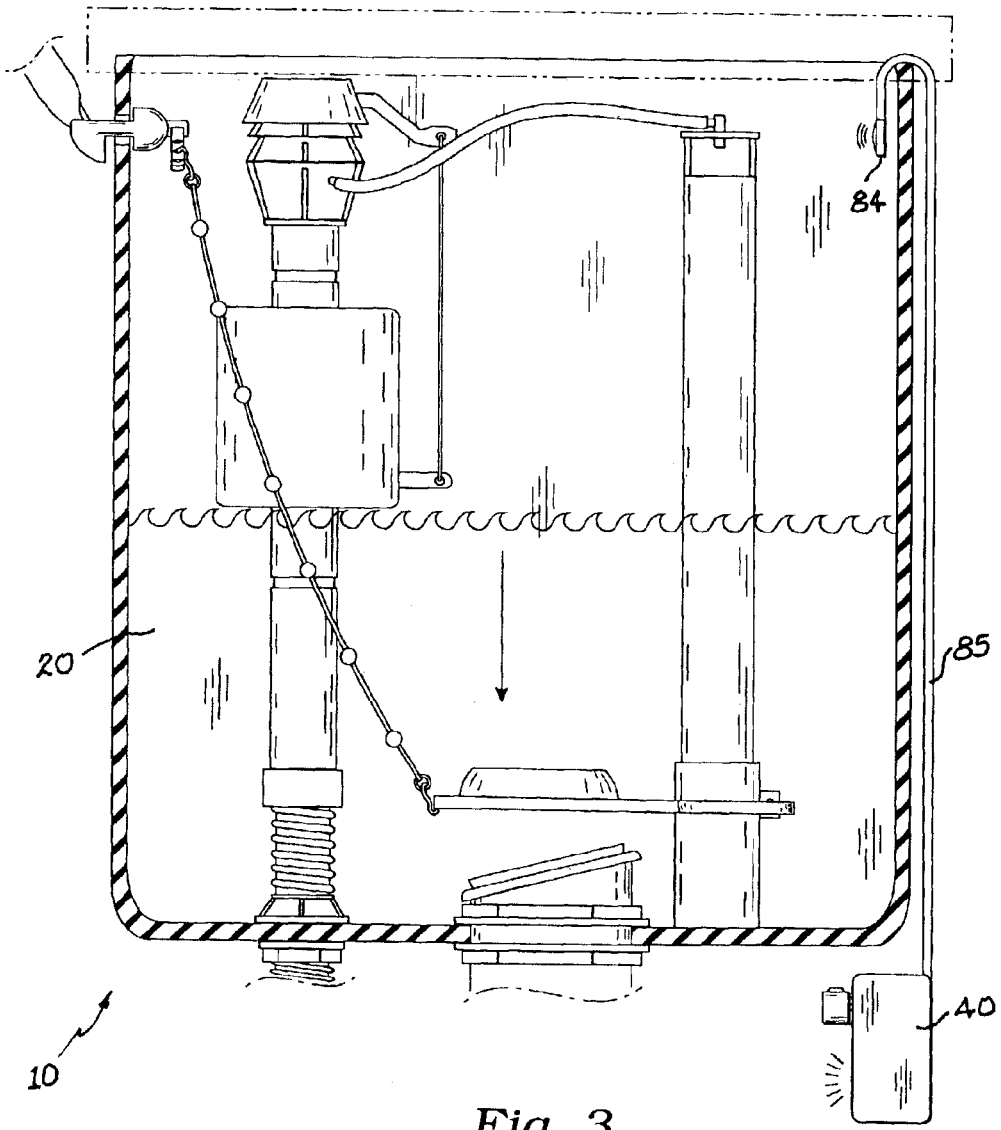
FIGS. 3 and 4 are cross sectional elevational views thereof.

As shown in FIGS. 1 and 2, the sound selecting circuit 66 provides a rotary switch. This switch is engaged with selected solid state devices containing the sounds of choice and such an enablement would be within the skill of one knowledgeable in the electrical arts as would be the amplifying circuit 68 and the speaker 70.

The rigid, upwardly extending arm 50 contains a signal wire 85 and this combination is considered a critical element of the novelty of the present invention. It is necessary to locate the enclosure 40 outside of the toilet tank 10 where it is not impacted by the high humidity, near 100%, within the tank 10 so that the circuit components within the enclosure 40 are safe from the effects of such humidity and can therefore be manufactured more inexpensively. On the other hand, the probes 80 and the microphone 84, in order to operate properly, must be located within the toilet tank 10. The probes 80 must be in contact with water 20 when the tank is filled and the microphone 84 must be able to preferentially pick up sounds within the tank 10. Clearly, with the microphone 84 located within the tank 10, sounds originating from outside the tank are less likely to be of significance enabling the discrimination task of notch filter 82 to be easier and therefore less expensive. Therefore, the rigid arm 50 with its signal wire 85 is a critical element. Also, the rigid arm is thin in its conformation so that it may be placed behind the toilet tank 10 even when the toilet tank is very close to a wall surface. This combination of elements is functional in achieving the objectives of the invention in a highly cost effective manner.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. An annunciating apparatus comprising in combination: a toilet tank containing water; an electrical circuit within an enclosure; and, extending upwardly from the enclosure, a rigid arm providing a hook engaging the toilet tank and terminating within the toilet tank with a microphone; the enclosure suspended from the rigid arm external to the toilet tank, the electrical circuit providing a source of electricity, an activating circuit, a sound producing circuit, an amplifying circuit and a speaker, the activating, producing, and amplifying circuits engaged with the speaker for enabling sound output through the speaker when the toilet tank is flushed, the rigid arm enabled for carrying an activating signal from the microphone inside the toilet tank to the enclosure, whereby, the microphone is isolated from sounds outside of the toilet tank.

2. The apparatus of claim 1 wherein the electrical circuit further provides a sound selecting circuit providing selection of any one of a plurality of sounds where such sounds are stored in at least one solid state memory device.

* * * * *